US007042407B2

(12) United States Patent
Syed et al.

(10) Patent No.: US 7,042,407 B2
(45) Date of Patent: May 9, 2006

(54) DUAL RADIUS TWIST LOCK RADOME AND REFLECTOR ANTENNA FOR RADOME

(75) Inventors: Junaid Syed, Kircaldy (GB); Matthew Lewry, Edinburgh (GB); Graeme Thomson, Milnahort (GB); Brian Lawson, Leven (GB)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 10/604,756

(22) Filed: Aug. 14, 2003

(65) Prior Publication Data

US 2005/0035923 A1 Feb. 17, 2005

(51) Int. Cl.
*H01Q 19/00* (2006.01)
*H01Q 1/42* (2006.01)

(52) U.S. Cl. ..... 343/705; 343/872

(58) Field of Classification Search ..... 343/705, 343/711, 832, 872, 878, 880, 890, 891, 907, 343/911 R, 913
See application file for complete search history.

(56) References Cited

U.S. PATENT DOCUMENTS

| | | | | |
|---|---|---|---|---|
| 4,179,699 A | | 12/1979 | Lunden | 343/705 |
| 4,189,731 A | | 2/1980 | Rope et al. | 343/872 |
| 4,581,615 A | * | 4/1986 | Levy | 343/755 |
| 4,804,972 A | * | 2/1989 | Schudel | 343/840 |
| 4,872,019 A | | 10/1989 | Chow et al. | |
| 4,901,086 A | | 2/1990 | Smith | 343/907 |
| 4,918,459 A | | 4/1990 | De Teso | 343/872 |
| 5,027,130 A | | 6/1991 | Akaba et al. | 343/872 |
| 5,652,631 A | | 7/1997 | Bullen et al. | 343/872 |
| D401,592 S | | 11/1998 | Nishimura et al. | |
| 5,844,529 A | | 12/1998 | Bell et al. | 343/872 |
| 5,907,310 A | * | 5/1999 | Seewig et al. | 343/786 |
| 5,958,557 A | | 9/1999 | Naor | 428/174 |
| 5,982,339 A | | 11/1999 | Lalezari et al. | 343/872 |
| 5,999,143 A | | 12/1999 | Glynn | 343/840 |
| 6,137,449 A | * | 10/2000 | Kildal | 343/781 P |
| 6,191,753 B1 | * | 2/2001 | Ellis et al. | 343/872 |
| 6,292,142 B1 | * | 9/2001 | Pittman | 343/700 MS |
| 6,437,757 B1 | * | 8/2002 | Butler | 343/872 |
| 6,522,305 B1 | * | 2/2003 | Sharman | 343/781 CA |
| 6,570,540 B1 | * | 5/2003 | Desargant et al. | 343/705 |
| 6,646,614 B1 | * | 11/2003 | Killen | 343/725 |
| 6,856,295 B1 | * | 2/2005 | Desargant et al. | 343/705 |

FOREIGN PATENT DOCUMENTS

GB 2 120 858 A 12/1983

* cited by examiner

*Primary Examiner*—Tan Ho
*Assistant Examiner*—Minh Dieu A
(74) *Attorney, Agent, or Firm*—Babcock IP, LLC

(57) ABSTRACT

A radome and a reflector antenna configured to mate with the radome. The radome has a central portion and a surrounding outer portion. The central portion having a radius selected to redirect a reflected component of the transmitted RF signal from the radome to the vertex area of the reflector. The outer portion has a larger radius selected to minimize radiation pattern degradation. RF absorbing material located at the vertex area reduces return loss of the reflector antenna. The radome attaches to the reflector via a plurality of tabs formed proximate the periphery of the radome that correspond to a plurality of cut outs in the periphery of the reflector. When inserted and rotated, the radome secures to the reflector without requiring tools.

22 Claims, 9 Drawing Sheets

DUAL RADIUS TWIST LOCK RADOME AND REFLECTOR ANTENNA FOR RADOME

BACKGROUND OF INVENTION

1. Field of the Invention

This invention relates to radomes and more particularly to a radome and reflector antenna pair having ease of installation and improved reflection/transmission characteristics.

2. Description of Related Art

Reflector antennas are used in, for example, communications systems. Radomes are used to cover the open end of the reflector to minimize wind loading and antenna performance degradation due to environmental fouling of the antenna reflector and or feed assembly.

Reflector antennas are subject to expansion and contraction due to temperature change. The reflector and the radome are formed from different materials, typically having different expansion coefficients. The interconnection between the radome and the reflector should accommodate differential expansion between the radome material and the reflector material, without compromising the mechanical attachment integrity or environmental seal between the radome and the reflector. Also, the interconnection should not create a stress that may deform the precision surfaces of the reflector and degrade the overall antenna reception sensitivity and or radiation patterns.

Prior radomes utilize a dielectric fabric, fiberglass or a molded dielectric plastic cover attached with a plurality of spring and or screw connections around the periphery of the reflector or a reflector shroud. The associated plurality of springs, clips, screws, and or brackets are a significant burden during installation and or service of the reflector antenna high upon radio towers or other difficult to access locations.

The radome also creates an impedance discontinuity within the RF signal path that generates a return loss due to RF reflections off of the radome directly or via further reflections back into the antenna feed. United Kingdom Patent Application No. 2120858 by Young, et al. published Dec. 7, 1983 discloses that a reflector antenna radome may be formed with concentric outer and inner parabioloidal portions so that a significant portion of reflected RF energy that may otherwise be aligned to reflect back into the antenna feed is instead directed by the inner parabioloidal portion to the backside of the feed assembly sub reflector where RF absorbing material may be located. However, the significantly reduced focal length of the inner parabioloidal portion necessary to direct the RF energy to the back of the sub reflector causes the radome to have a significant center protrusion and associated additional structural mass, negatively affecting the windload and or other structural requirements of the radome, reflector antenna and support structure. Also, the center protrusion provides a surface for snow and or ice build up.

Competition within the reflector antenna industry has focused attention on RF performance, structural integrity, materials and manufacturing operations costs. Also, ease of installation and service is a growing consideration in the reflector antenna market.

Therefore, it is an object of the invention to provide an apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Signals reflected from a radome surface that is tangential to the desired signal direction would be straight back into the signal path, contributing to the return loss of the reflector antenna. Also, reflections proximate the feed assembly encounter multiple surfaces from which to launch reflections that may finally be directed back to the feed, further contributing to return loss. A radome with a small radius reflects signals out of the signal path but also degrades the far field radiation pattern. Further, radomes with small radius configurations have an extended dimension along the signal axis of the reflector antenna, increasing the wind load and associated mechanical strength requirements for the reflector antenna and antenna support structure. The present invention utilizes a very large radius in an outer portion and a smaller radius for a central portion that is significantly larger (has a focal point at the reflector vertex area rather than the back side of the antenna feed) than central areas of two section radomes in the prior art. The radome configuration according to the invention provides return loss, signal pattern improvements and a reduction in wind load.

Figure 1A:
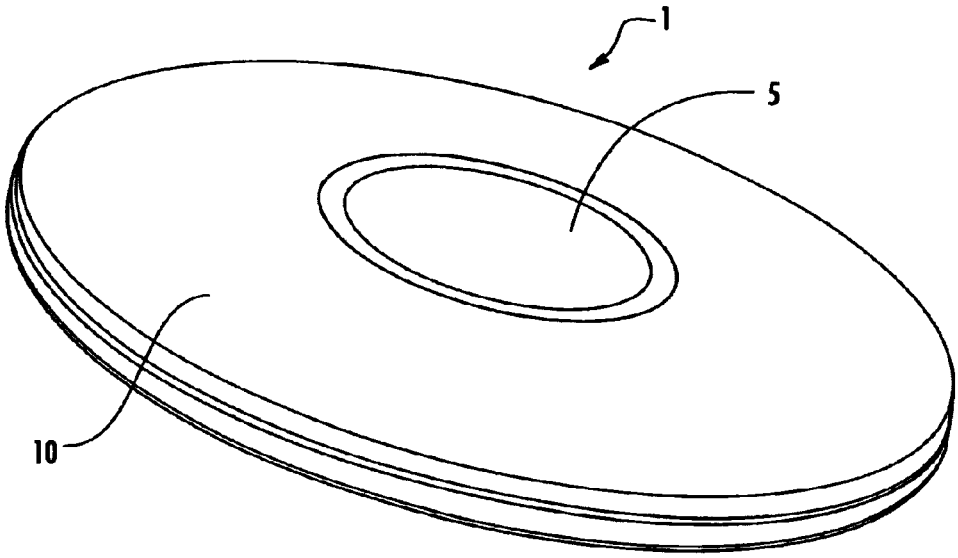
FIG. 1*a* is an isometric view of one embodiment of a radome according to one embodiment of the invention, showing the front surface and side edge.
Figure 1B:
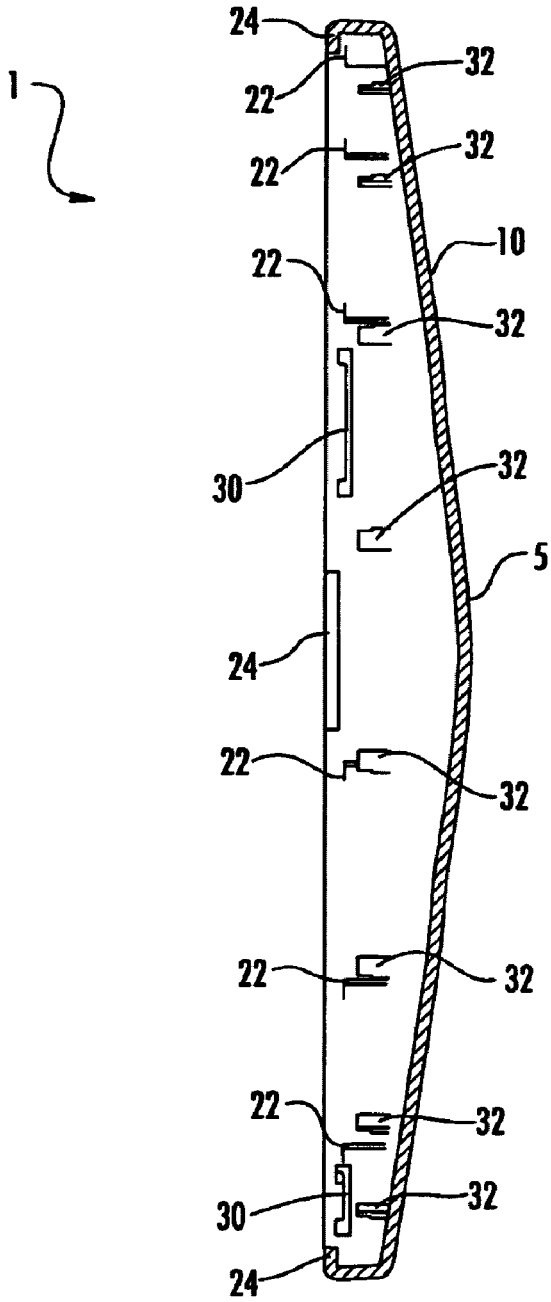
FIG. 1*b* is a cross-section side view of FIG. 1.
Figure 2:
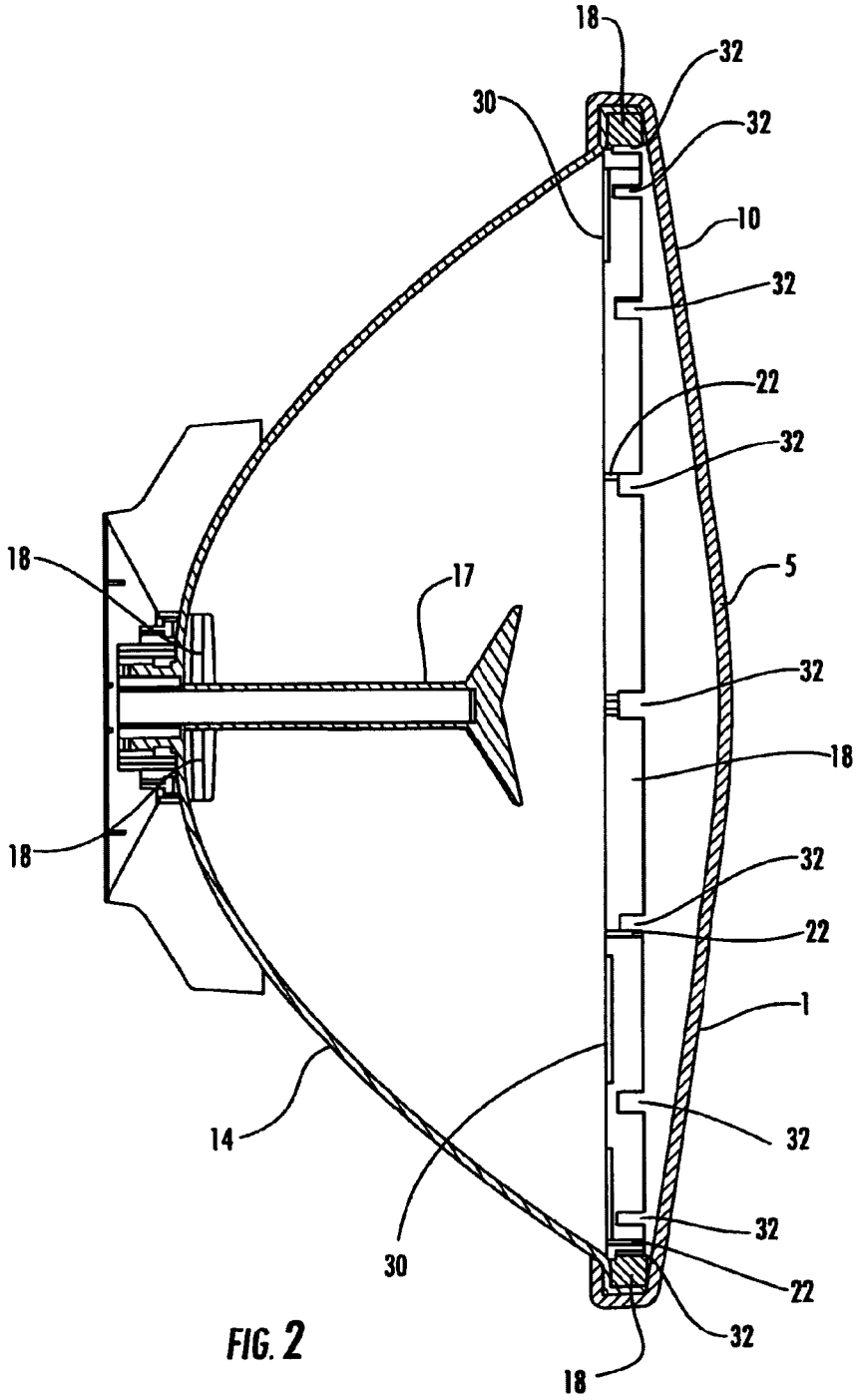
FIG. 2 is a cross-section side view of a reflector antenna with a radome according to one embodiment of the invention.

For purposes of illustration, a first embodiment of the invention is shown in FIGS. 1*a* and *b*. The radome 1 is dimensioned for use with a desired reflector antenna configuration, for example a deep dish reflector antenna with a self supported feed assembly as shown in FIG. 2. The radome 1 may be, for example, injection molded from a dielectric plastic such as ASA (acrylonnitrile styrene acrylate), polycarbonate or other materials with suitable strength, dielectric properties and UV stability. The radome 1 has a central portion 5 and an outer portion 10. The central portion 5 having a smaller radius than the outer portion 10. Specific radius configurations may be selected according to the desired reflector antenna the radome 1 is intended for.

Figure 3:
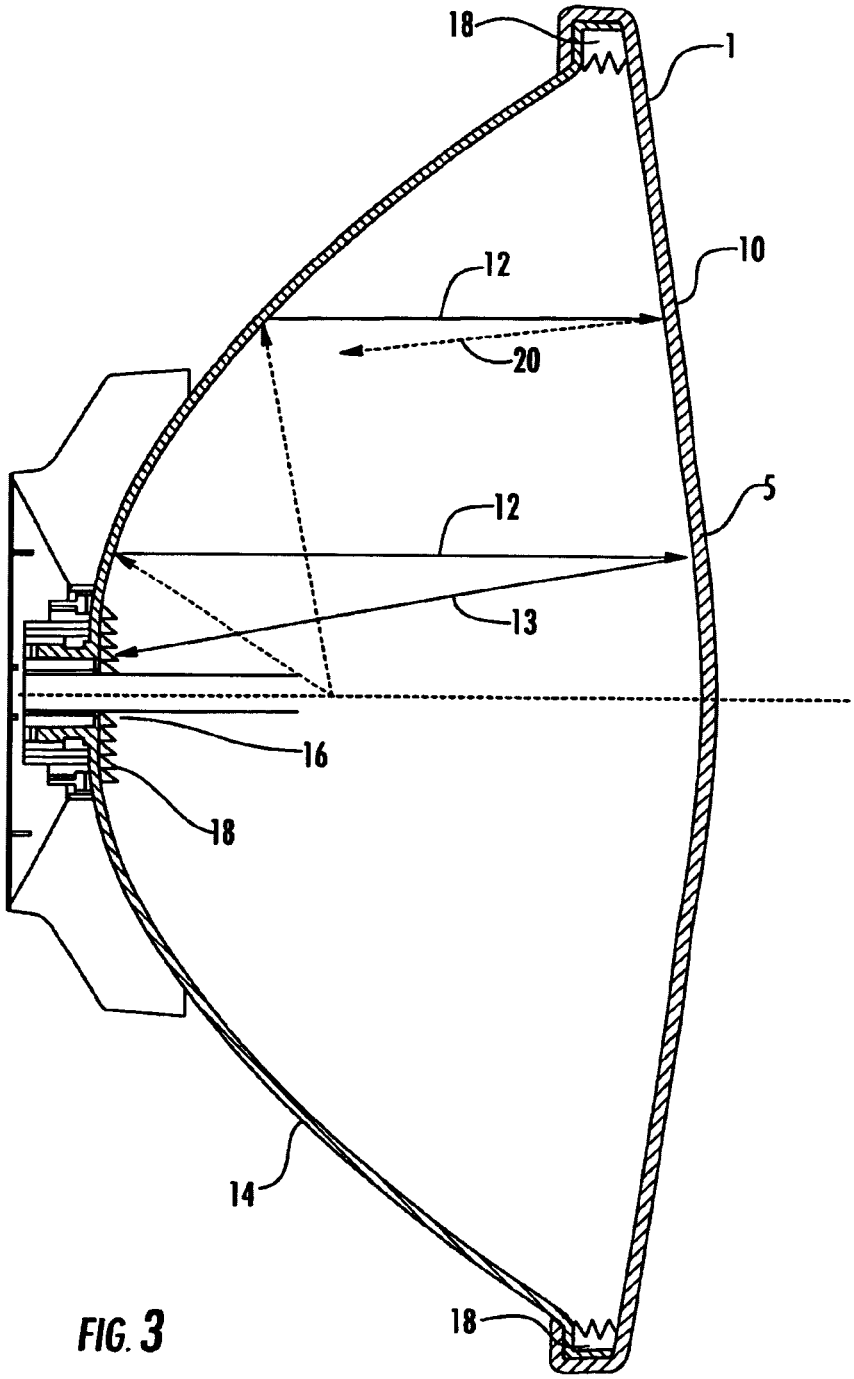
FIG. 3 is a side schematic view of a reflector antenna section, structure removed for clarity, showing ray traces of reflections from the radome of FIGS. 1 and 2.

As shown by FIG. 3, the different radii of the central and outer portions 5,10 creates a reflection pattern that varies depending upon the radome 1 surface that incident RF 12 reflects from. The selected central portion 5 radius will depend upon the particular focal length and diameter of the desired reflector. The central portion 5 radius is configured so that an inner reflected component 13 of RF signals incident upon the central portion 5 is focused upon the reflector 14 vertex area 16. The vertex area 16, shaded by the antenna feed assembly 17, is not a reflector 14 surface used to project the RF signal into the desired radiation pattern. RF absorbing material 18 placed at the vertex area 16 may be used to absorb the portion of the reflected component 13 that is reflected by the radome 1 central portion 5 thereby preventing further reflections from the vertex area 16 that may be aligned with the antenna feed which would otherwise contribute to the return loss of the reflector antenna, overall.

The large radius of the outer portion 10 is selected to create outer reflected component(s) 20 that are not aligned with the feed path and therefore are not significant contributors to return loss of the antenna. Also, the large radius of the outer portion 10 introduces only minimal far field signal pattern degradation. For example, the outer portion 10 radius may be 1–2 meters for a one foot reflector antenna and 2–3 meters for a 2 foot reflector antenna.

The transition between the central portion 5 and the outer portion 10 is configured to occur at the point closest to the center of the radome 1 which does not create outer reflected component(s) 20 that reflect from the reflector 14 upon the feed assembly.

The radome 1 may be mounted to the reflector 14 by any manner of interconnection, for example screws, clips, springs and or brackets.

Figure 4:
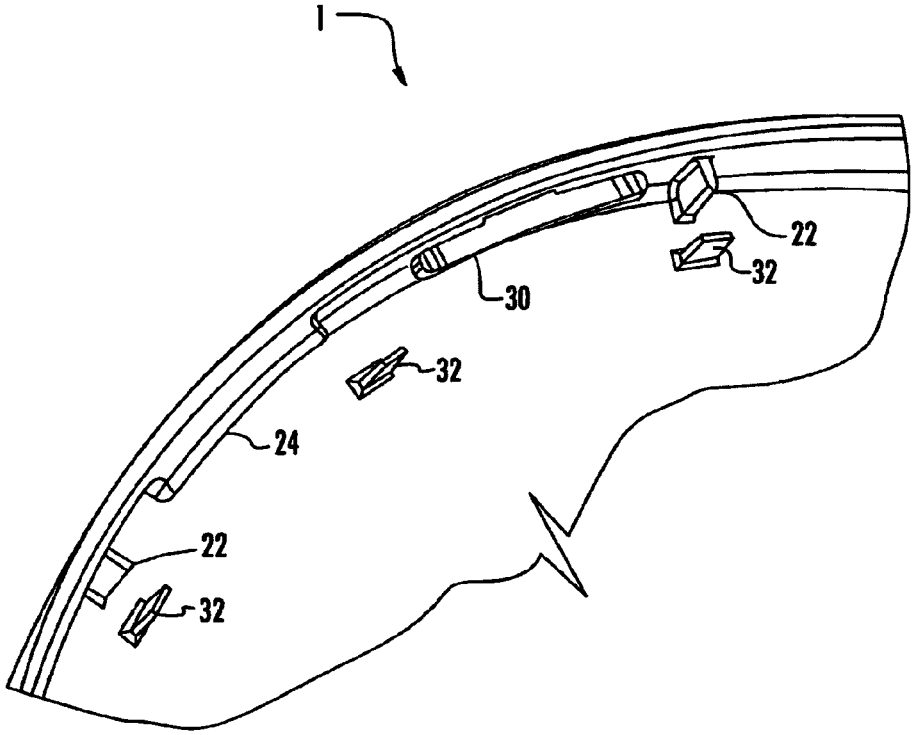
FIG. 4 is an isometric close-up view of the back surface outer edge of the radome of FIGS. 1 and 2.
Figure 5:
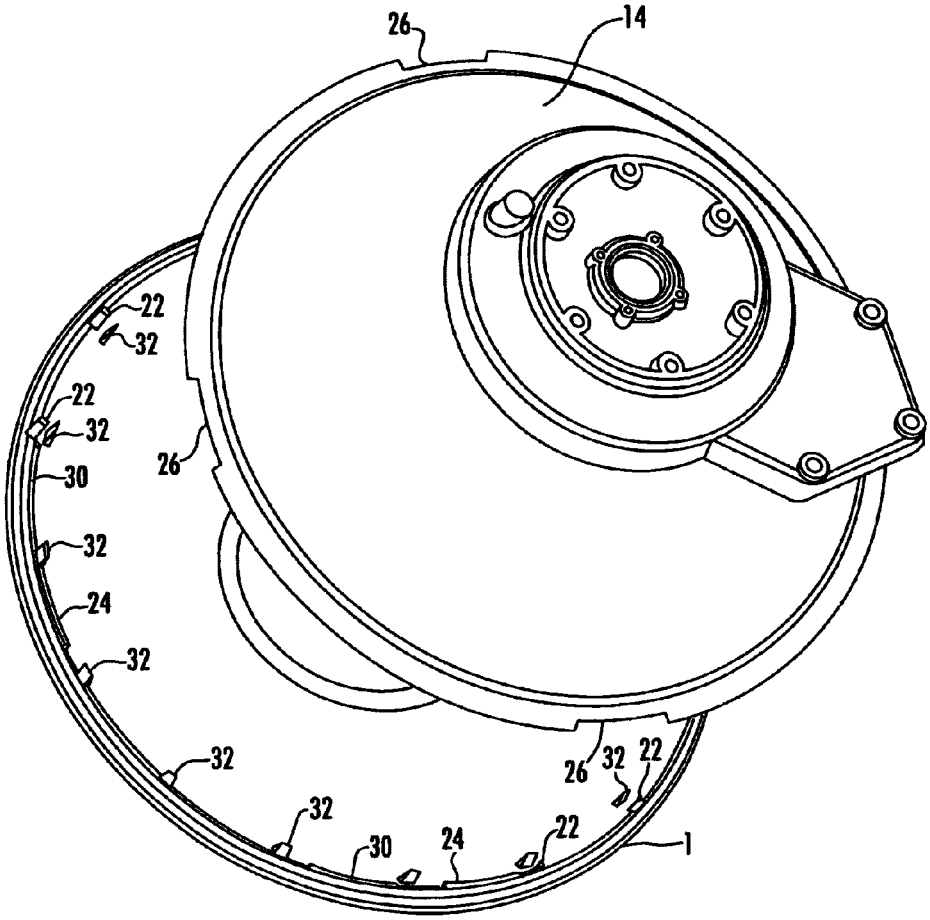
FIG. 5 is an isometric back view of the radome of FIGS. 1 and 2 aligned for connection with a reflector.
Figure 6:
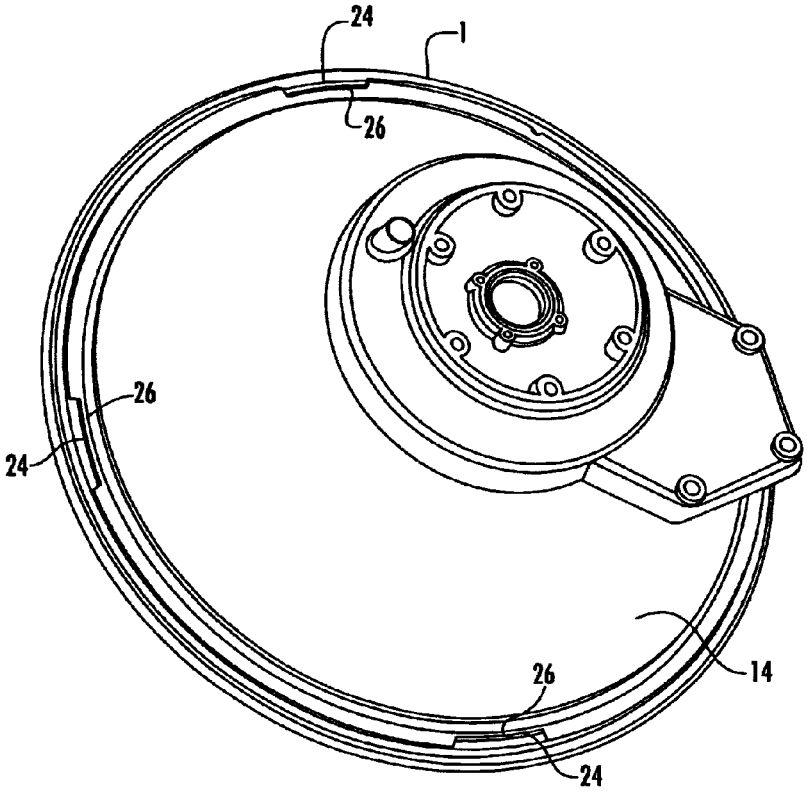
FIG. 6 is an isometric back view of the radome and reflector of FIG. 5 keyed together prior to locking.
Figure 7:
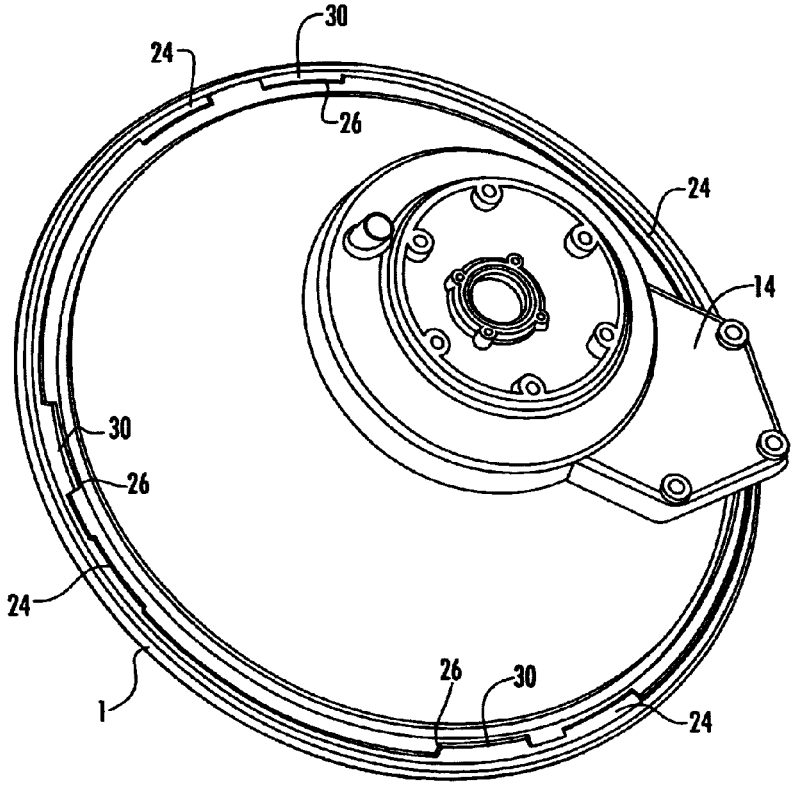
FIG. 7 is an isometric back view of the radome and reflector of FIG. 5 locked together.
Figure 8:
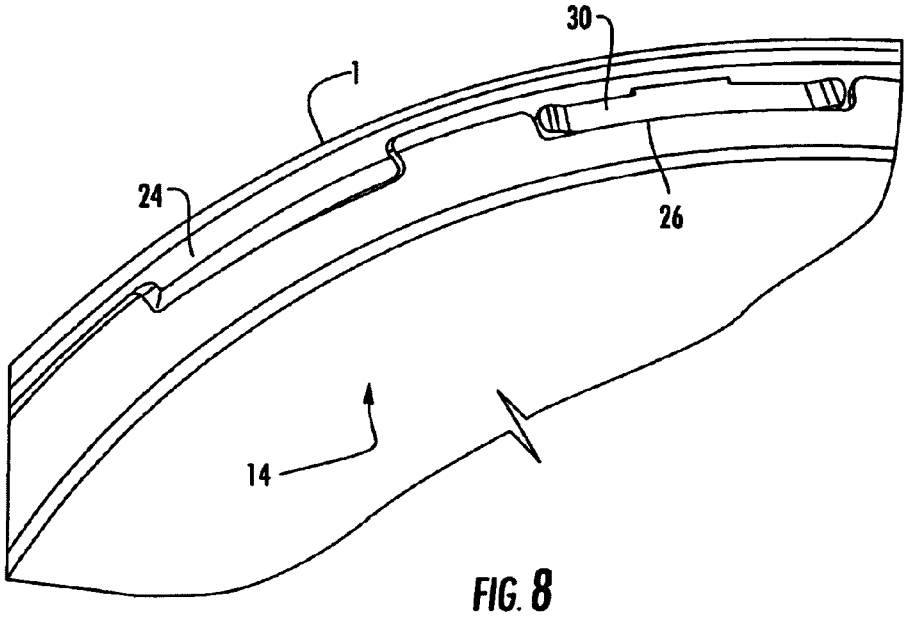
FIG. 8 is an isometric close up view of FIG. 7, showing details of the radome and reflector interlock.

As shown by FIG. 4, the periphery of the radome 1 may have integrated structure for tool-less interconnection between the radome 1 and the reflector 14. A plurality of support posts 22 may be used to create a mounting plane for the radome 1. A plurality of tabs 24 cooperating with a corresponding plurality of cut outs 26 formed in the periphery of the reflector 14 operate to retain the radome 1. When the tabs 24 and cut outs 26 are aligned with each other, as shown in FIG. 5, the radome 1 can be placed upon the reflector 14, the tabs 24 passing through the cut outs 26, until the radome 1 support posts 22 bottom upon the periphery of the reflector 14, as shown in FIG. 6. The radome 1 may then be rotated about the face of the reflector 14, separating the tabs 24 from the cut outs 26, thereby retaining the radome 1 against the reflector 14 periphery. Locking clips 30, momentarily compressed by the reflector 14 periphery snap out into the reflector 14 cut-outs 26 as the radome 1 is rotated. When snapped into place, within the cut outs 26, the locking clips 30 prevent further rotation of the radome 1 with respect to the reflector 14, forming a secure connection between the radome 1 and the reflector 14, as shown in FIGS. 7 and 8.

The radome 1 is secured by the interference between the tabs 24 and the periphery of the reflector 14 without cut outs 26 and the locking clips 30 within the cut outs 26, but otherwise floats in place. Therefore, there is no need for a mechanical fastener such as a rigid screw connection between the two components. Because both the radome 1 and the reflector 14 are free to expand or contract separately, according to the expansion coefficient of each, the chance of unequal expansion between the two causing a deformation of the radome 1 and or reflector 14 is reduced.

The signal pattern of the reflector antenna may be improved by adding a shroud lined with RF absorbing material around the periphery of the reflector. However, prior shrouds created a significant increase in the wind load of the resulting reflector antenna. Deep dish reflector configurations decrease the need for a full shroud. To obtain the partial benefit of a full shroud with a deep dish reflector 14, without increasing the windload of the antenna, RF absorbing material 18 may be added at the periphery of the reflector, under the radome 1. Absorber retainers 32 may be formed in the periphery of the radome 1 as mounting structure for retaining strip(s) or a ring of RF absorbing material 18.

The present invention brings to the art a radome with an improved RF signal pattern, return loss, wind loading and snow/ice buildup characteristics. Further the radome has a secure radome to reflector antenna mounting that allows relative expansion of the different components and does not require tools or multiple extra components that may create a drop hazard, be easily misplaced and or lost.

Table of Parts

| | |
|---|---|
| 1 | radome |
| 5 | central portion |
| 10 | outer portion |
| 12 | incident RF |
| 13 | reflected component |
| 14 | reflector |
| 16 | vertex area |
| 17 | feed assembly |
| 18 | RF absorbing material |
| 20 | outer reflected component |
| 22 | support post |
| 24 | tab |
| 26 | cut out |
| 30 | locking clip |
| 32 | absorbing retainer |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A radome for a reflector antenna having a reflector with a vertex area, the radome comprising:

a central portion surrounded by an outer portion;

the central portion having a radius configured to focus a reflected component of an RF signal reflected by the reflector antenna to the vertex area;

the outer portion having a radius greater than the central portion; and the central portion consisting of a dielectric material.

2. The radome of claim 1, wherein a transition between the central portion and the outer portion is located at a position where the reflected component from the outer portion closest to the transition reflects from the reflector without intersecting with a feed assembly of the reflector antenna.

3. The radome of claim 1, wherein the radome is injection molded dielectric plastic.

4. The radome of claim 1, further including a plurality of tabs formed proximate a periphery of the radome;

the tabs configured to pass through a corresponding plurality of cut outs formed in a periphery of the reflector.

5. The radome of claim 4, wherein the tabs retain the radome on the reflector when the radome is rotated after the tabs are passed through the cut outs.

6. The radome of claim 4, further including a plurality of support posts formed proximate the periphery of the radome which the reflector seats against when the tabs are passed through the cut outs.

7. The apparatus radome of claim 4, further including a plurality of locking clips configured to compress when the tabs are passed through the cut outs;

the locking clips decompressing into the cut outs when the radome is rotated after the tabs are passed through the cut outs;

the locking clips decompressed into the cut outs inhibiting further rotation of the radome.

8. The radome of claim 1, further including a plurality of absorbing retainers arranged proximate a periphery of the radome.

9. The radome of claim 1, further including RF absorbing material located in the vertex area.

10. A radome for a reflector antenna having a reflector with a vertex area, the radome comprising:

the radome adapted to cover an open end of the reflector;

a plurality of tabs formed proximate a periphery of the radome;

the tabs configured to pass through a corresponding plurality of cut outs formed in a periphery of the reflector.

11. The apparatus of claim 10, wherein the tabs retain the radome on the reflector when the radome is rotated after the tabs are passed through the cut outs.

12. The apparatus of claim 10, further including a plurality of support posts formed proximate the periphery of the radome which the reflector seats against when the tabs are passed through the cut outs.

13. The apparatus of claim 10, further including a plurality of lacking clips configured to compress when the tabs are passed through the cut outs;

the locking clips decompressing into the cut outs when the radome is rotated after the tabs are passed through the cut outs;

the locking clips decompressed into the cut outs inhibiting further rotation of the radome.

14. The apparatus of claim 10, further including a plurality of absorbing retainers arranged proximate a periphery of the radome.

15. A reflector antenna, comprising:

a reflector with a vertex area;

a feed assembly coupled to the reflector proximate the vertex area;

a plurality of cut outs in a periphery of the reflector;

a radome adapted to cover an open end of the reflector;

the radome having a plurality of tabs arranged to correspond with the cut outs;

the tabs and the cut outs co-operating to removably secure the radome to the reflector;

the radome having a central portion with a radius selected to focus a reflected component of RF signals transmitted by the reflector antenna upon the vertex area; and the vertex area covered by an RF absorbing material.

16. The reflector antenna of claim 15, further including a surrounding portion of the radome having a larger radius than the central portion.

17. The reflector antenna of claim 15, further including a plurality of absorbing retainers proximate a periphery of the radome; the absorbing retainers retaining a ring of RF absorbing material.

18. An antenna comprising:

a feed;

a reflector; and a radome adapted to cover said reflector;

the reflector and radome having interlocking peripheral structures configured such that said radome is joined to said reflector by mating said structures and rotating said radome relative to said reflector.

19. The antenna of claim 18 wherein one of said reflector and radome has cut-outs spaced about its periphery and the other has mating tabs adapted to be received into said cut-outs when said radome and reflector are mated before said rotating.

20. An antenna comprising:

a self supported feed assembly;

a circular reflector; and a circular radome adapted to cover said reflector;

the reflector and radome having interlocking peripheral structures configured such that said radome is joined to said reflector by mating said structures and rotating said radome relative to said reflector.

21. A circular radome for a circular reflector antenna having about its periphery a twist-lock interconnection structure configured to interlock with a mating interconnection structure on the reflector when the radome is rotated relative to the reflector.

22. A circular antenna reflector adapted to mate with a circular radome, the reflector having about its periphery a twist-lock interconnection structure configured to interlock with a mating interconnection structure on the radome when the radome is rotated relative to the reflector.

* * * * *